United States Patent [19]

Croteau et al.

[11] 4,426,016

[45] Jan. 17, 1984

[54] CONVERTIBLE DISPENSING MECHANISM FOR VENDING MACHINE

[75] Inventors: James Croteau, Hartford; John A. Enders, Simsbury, both of Conn.

[73] Assignee: Choice Vend Industries, Inc., Windsor Locks, Conn.

[21] Appl. No.: 290,091

[22] Filed: Aug. 4, 1981

[51] Int. Cl.[3] ..... G07F 11/36

[52] U.S. Cl. ..... 221/75; 221/114; 221/222

[58] Field of Search ..... 221/67, 75, 114, 116, 221/118, 222

[56] References Cited

U.S. PATENT DOCUMENTS

| | | | |
|---|---|---|---|
| 2,493,753 | 1/1950 | Devens | 221/111 |
| 2,496,689 | 2/1950 | Balzer | 221/129 X |
| 2,564,552 | 8/1951 | Verdery | 221/13 X |
| 3,036,730 | 5/1962 | Newberry | 221/114 X |
| 3,810,560 | 5/1974 | Stegeman | 221/116 |
| 3,855,873 | 12/1974 | Fletcher et al. | 74/436 |

FOREIGN PATENT DOCUMENTS

| | | | |
|---|---|---|---|
| 803847 | 1/1969 | Canada | 221/75 |

*Primary Examiner*—F. J. Bartuska

[57] ABSTRACT

A helical carrier mechanism for dispensing bottles and cans from a vending machine has at least one carrier which can be rendered inoperative and non-interfering, such as by removal, to permit facile conversion between two- and three-deep alternative modes of operation. The mechanism may include a cover that is configured to cooperate with the internal walls and hopper of the machine, to afford smooth, gentle and dependable dispensing of the product.

10 Claims, 14 Drawing Figures

130
142
138
140
134
128
136
146
144
132
160
33
102
64
62
112
104
58
106
108
68
66
71
126
150B
150A
154
156
152
158
118
124
150
132
114
122
150D
150C
120
116
54

CONVERTIBLE DISPENSING MECHANISM FOR VENDING MACHINE

BACKGROUND OF THE INVENTION

Automatic vending machines for packaged soft drinks and the like normally consist of a thermally insulated, refrigerated cabinet, which is partitioned to provide several vertical chambers, or magazines, in which cans or bottles of the product can be stacked lengthwise, one upon another. The dispensing mechanism utilized in such a machine typically consists of several upright helical carriers, on which the containers are supported. Upon actuation (i.e., following coin deposit and selection), the carriers rotate to remove the lowermost containers from the stacks, carrying them downwardly within their convolutions, and then dropping them when the ends of the helicies are reached. The helicies cooperate with adjacent vertical walls of the machine to trap the containers within their convolutions, and the end of the convoluted portion of each helix will generally terminate in a flat, vertical face. Thus, when this relieved portion achieves a position substantially parallel to the cooperating wall, sufficient space is provided for passage of one of the containers, which will therefore fall into an underlying trough or chute for delivery to the customer. The helicies are disposed in such a phase relationship that only one container will be dispensed at a time.

Generally, the helices will be used in pairs to provide two-point underlying support for each container, although a single carrier may suffice if other supporting means (such as supplemental walls adjacent the ends of the containers) is provided. The paired helices will have oppositely directed convolutions, and will be timed to ensure clean relese of the containers at the drop point. By defining a magazine to each side of the helices (such as with a vertical partition disposed on their axes to subdivide the overlying chamber) a single helix (or a mated pair) may be used to dispense from two laterally adjacent stacks, with a container being released in each of two, 180°-phase displaced positions of any particular carrier. Normally, several stacks of various products will be accommodated across the width of the machine, and will be dispensed by different, independently actuated mechanisms.

To provide maximum capacity, standard bottle and can vending machines are also designed to accommodate stacking of the containers one behind the other in the magazines, rather than in single-column depth. With such an arrangement, each dispensing mechanism will include a row of several carriers, all activated simultaneously by the same selector on the machine. While advantageous from the standpoint of increased capacity, multiple-depth stacking does tend to introduce control problems. Thus, assuming discharge from two laterally adjacent stacks, a mechanism designed for double-depth vending will effect discharge from four stacks in all, thereby requiring four release points, 90° out of phase with one another. For triple-depth use, a single mechanism will operate upon six stacks, requiring that the release positions be only 60° out of phase.

Because the containers are normally stacked lengthwise (i.e., with their axes horizontal and aligned from front-to-rear in the machine) the number of stacks that can be accommodated in the depth direction will depend upon the height of the product package. More particularly, since the typical 12-ounce beverage bottle may be approximately 50 percent taller than the standard 12-ounce beverage can, only two bottles can be accommodated in the space that would hold three cans. Hence, in most practical terms, the greatest latitude for choice of product usage would be provided by a vending machine that offers the capability of conversion between double- and triple-depth stacking; as far as is known, no machine (or more specifically, no dispensing mechanism therefor) heretofore provided or described affords that capability. Moreover, and as has been pointed out hereinabove, the provision of increased capacity and latitude of application for such a machine introduces control and operational difficulties not previously encountered or addressed; hence, even appreciating the desirability of affording such features, the means for accomplishing the same has not been suggested previously.

Accordingly, it is a primary object of the present invention to provide a novel dispensing mechanism for a vending machine, which may readily be converted to different modes of operation, for selective use with either double- or triple-depth stacking.

Another object of the invention is to provide such a mechanism in which conversions can be made with a high degree of facility.

Yet another object of the invention is to provide a novel mechanism of the foregoing sort, and a novel vending machine incorporating the same, which effect dispensing of the articles smoothly, relatively gently and is a most dependable and desirable manner.

A still further object of the invention is to provide such a mechanism, which is relatively uncomplicated in design, and hence convenient to adjust and service and relatively inexpensive to manufacture.

SUMMARY OF THE INVENTION

It has now been found that certain of the foregoing and related objects of the invention are readily attained in a dispensing mechanism comprising support means, including a base, and at least three gear members mounted thereon in meshing engagement with one another for simultaneous rotation about parallel, generally rectilinearly aligned axes. At least three helical carriers are vertically mounted on the support means and are adapted to support the articles generally horizontally within their convolutions. Each of the carriers is aligned on the axis of rotation of one of the gear members, and has an upper and a lower helix portion. The upper helix portion of the carrier is adapted to receive the cylindrical articles, and the lower helix portion is adapted to permit their release at at least one rotational position of the carrier. The mechanism also includes means for affixing the carriers to the gear members for conjoint, coaxial rotation, and conversion means for selectively rendering at least one of the carriers inoperative for dispensing, and non-interfering. As a result, the articles, which are withdrawn from the stacks and progressively lowered within the convolutions of the carriers during their rotation, can be discharged in a predetermined sequence which depends upon the relationship existing between the lower helix portions of the carriers. The mechanism may be employed to dispense the articles from three stacks disposed one behind another in the machine, and it may readily be converted, with the conversion means, for the dispensing of articles from only two to such stacks.

In preferred embodiments of the invention, the affixing means disengageably affixes the "one" carrier to the associated gear member, rendering the carrier removably mounted in the support means, in which case the affixing means at least in part provides the conversion means of the mechanism. Most desirably, such affixing means will selectively disengageably affix the "one" carrier, and at least one other carrier of the mechanism, to associated gear members in any of a plurality of angularly displaced positions, to permit alteration thereof and thereby the timing of discharge, to accommodate either mode (i.e., double or triple depth stacking) of operation. The support means may additionally include means for biasing the "one" carrier toward the base, so as to render it axially displaceable away from the base against the force of the biasing means. In more specific terms, the frame portion may comprise upstanding members attached adjacent the opposite ends of the base, and a tie bar or crosspiece extending longitudinally above the base and supported upon the upper ends of the upstanding members. In such a structure, the biasing means will act to bias the tie bar toward the base. For the purpose of interengaging the carriers with the gear members, the latter may each have an axial, upwardly opening socket in which a lower end portion of the carrier is seated, with the socket and the end portion being cooperatively dimensioned and configured to afford such interengagement in each of a plurality of angularly displaced relative positions. However, alternative interengaging means may be used, and will be apparent to those skilled in the art.

In especially preferred embodiments of the invention, a mechanism of the foregoing sort will employ six gear members and carriers, with the carriers affixed so as to coact in pairs; in that event, each of the pairs of carriers will serve to dispense the articles from different stacks. At least one of the pairs of carriers will be removably mounted in the support means to enable conversion to be readily effected. It is especially desirable that all of the carriers be selectively disengageably affixed by the affixing means, and normally, they will all be interchangeably and removably mounted.

In the usual case, the mechanism of the invention will include a motor operatively connected to drive the gear members, with a limit switch being provided in the energizing circuit of the motor. The switch will be operatively connected to at least one of the gear members to cause deenergization of the motor (depending upon the positions of the gear members) each time that the lower helix portion of any of the carriers is in one of the article-release rotational positions thereof. To operate the limit switch, one of the gear members may have camming means thereon capable of presenting different members of cam elements, to adapt the switch function to the mode of operation desired. This may be achieved by utilizing a cam member having cam elements extending radially outwardly from its axis, disengagably mounted on one of the gear members. Such a cam member may be divided, at a plane perpendicular to its axis, into first and second portions, with the number of cam elements presented by the first portion being different from that presented by the second portion. Thus, the number of cam elements effectively presented to the switch may be changed by reversing the position of mounting of the cam member upon the gear member.

Additional objects of the invention are provided in a vending machine including at least one dispensing mechanism generally having the features described hereinbefore. However, the mechanism will additionally include a cover extending over the base and enclosing the gear members. The cover has an upper wall portion through which the carriers project, and sloped shoulder portions extending longitudinally along both sides thereof. Such a machine will additionally include a plurality of walls defining at least two laterally adjacent magazines for containing the stacks of articles, with one of the magazines being disposed to each side of the dispensing mechanism. The wall between the adjacent magazines will lie in a plane passing through the vertical axes of the carriers, and the outer walls defining the magazines will have lower edges aligned parallel with, and offset laterally above, the adjacent shoulder portion of the cover. As a result, longitudinally passages of uniform width will be defined along the bottom and to each side of the dispensing mechanism. The machine will also have at least one hopper disposed below the dispensing mechanism and positioned to receive the articles discharged from the carriers thereof. Thus, the articles will be discharged smoothly and gently laterally through the longitudinally extending passages, and ultimately dispensed from the machine.

Preferably, the upper wall portion and the shoulder portions of the cover of the dispensing mechanism used in such a machine will each be substantially planar, and the cover will desirably include sidewall portions depending from the shoulder portions to substantially enclose the base of the mechanism. The hopper of the machine will generally have a bottom wall that slopes downwardly toward the front, which advantageously will terminate a substantial distance short of the rear of the machine. This will maximize its angle of decline, and will thereby promote movement of dispensed articles toward the front of the machine.

In especially desirable embodiments, the mechanism may include a drive train operatively connecting the motor to the gear members, and comprising Geneva movement means for positively limiting the arc of rotation of the gear members, thereby precisely locating and maintaining the release positions thereof. The Geneva movement means utilized in such a mechanism may advantageously comprise a driven indexing wheel and a radially adjacent drive wheel. The indexing wheel may have formed therein a multiplicity of equidistantly spaced, inwardly extending radial slots and arcuate recesses therebetween. The drive wheel may correspondingly have a cylindrical hub portion extending axially outwardly from one side thereof, with an arcuate recess formed therein, and a drive pin spaced radially outwardly from the hub, disposed on the radius of the hub recess and extending outwardly from the same side of the drive wheel. The slots of the indexing wheel will correspond in number to the article release positions of the carriers, and will be dimensioned to slidingly engage the drive pin of the drive wheel for partial rotation of the indexing wheel thereby through an appropriate, limited arc. The hub of the drive wheel will engage one of the arcuate recesses of the indexing wheel adjacent the engaged slot to constrain the indexing wheel against further rotation, except when the pin is substantially bottomed within the engaged slot. Thereupon, the recess of the hub will be presented to the indexing wheel, permitting passage of its elements therethrough and rotation thereof.

DETAILED DESCRIPTION OF THE ILLUSTRATED EMBODIMENTS

Figure 1:
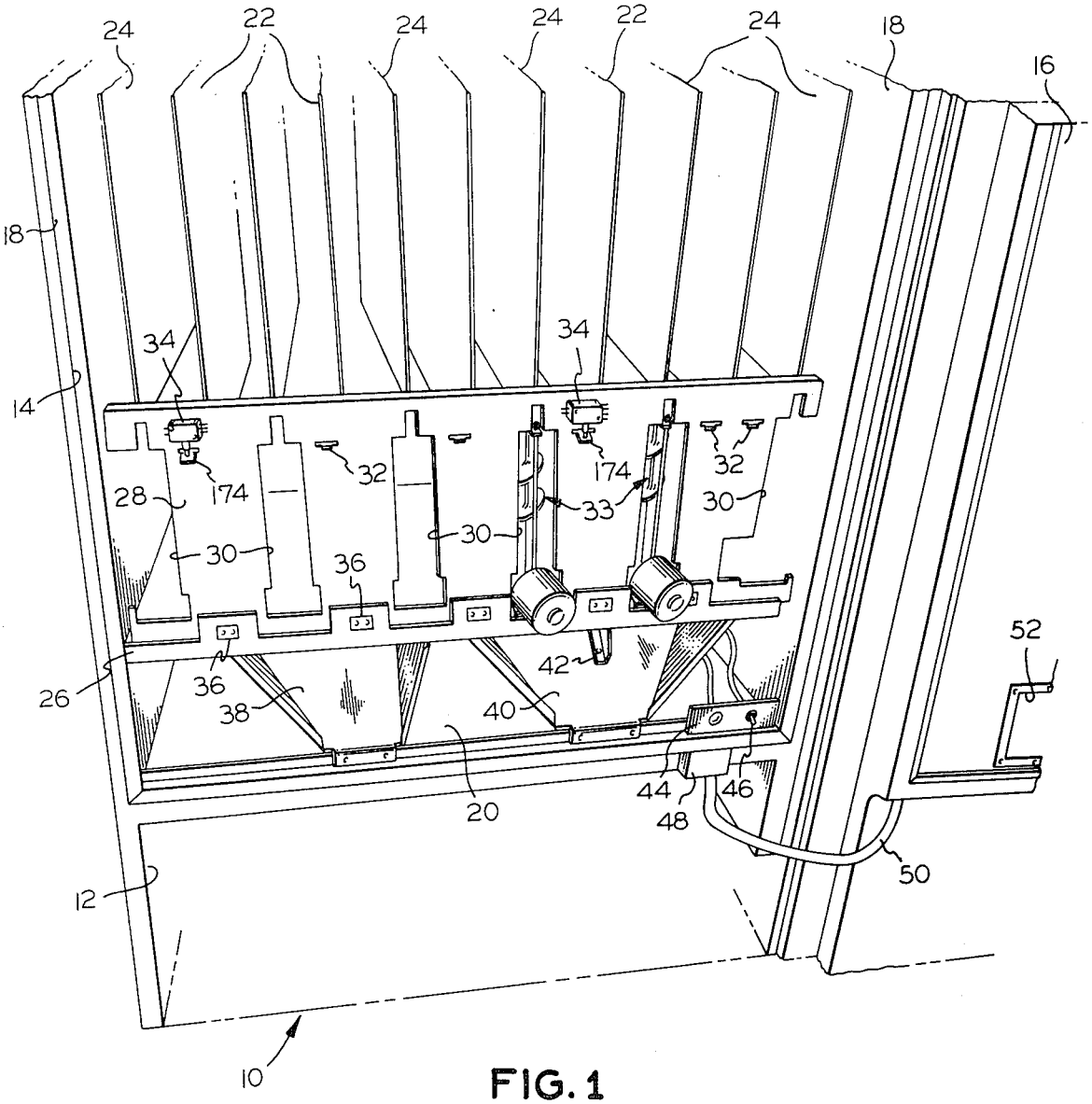
FIG. 1 is a fragmentary perspective view of a vending machine embodying the present invention and incorporating the dispensing mechanism thereof.

Turning now in detail particularly to FIG. 1 of the drawings, therein illustrated is a vending machine embodying the present invention, and including a housing or insulated cabinet, generally designated by the numeral 10. The housing 10 is divided by a horizontal internal wall 11 into a lower compartment 12 and an upper compartment 14, and double doors (only the innermost one 16 of which is illustrated in FIG. 1) are hingedly mounted to close the front of the cabinet, in a conventional manner. The lower compartment 12 of the cabinet may house the refrigeration system (not shown), normally utilized to cool the product to be dispensed from the machine.

Figure 11:
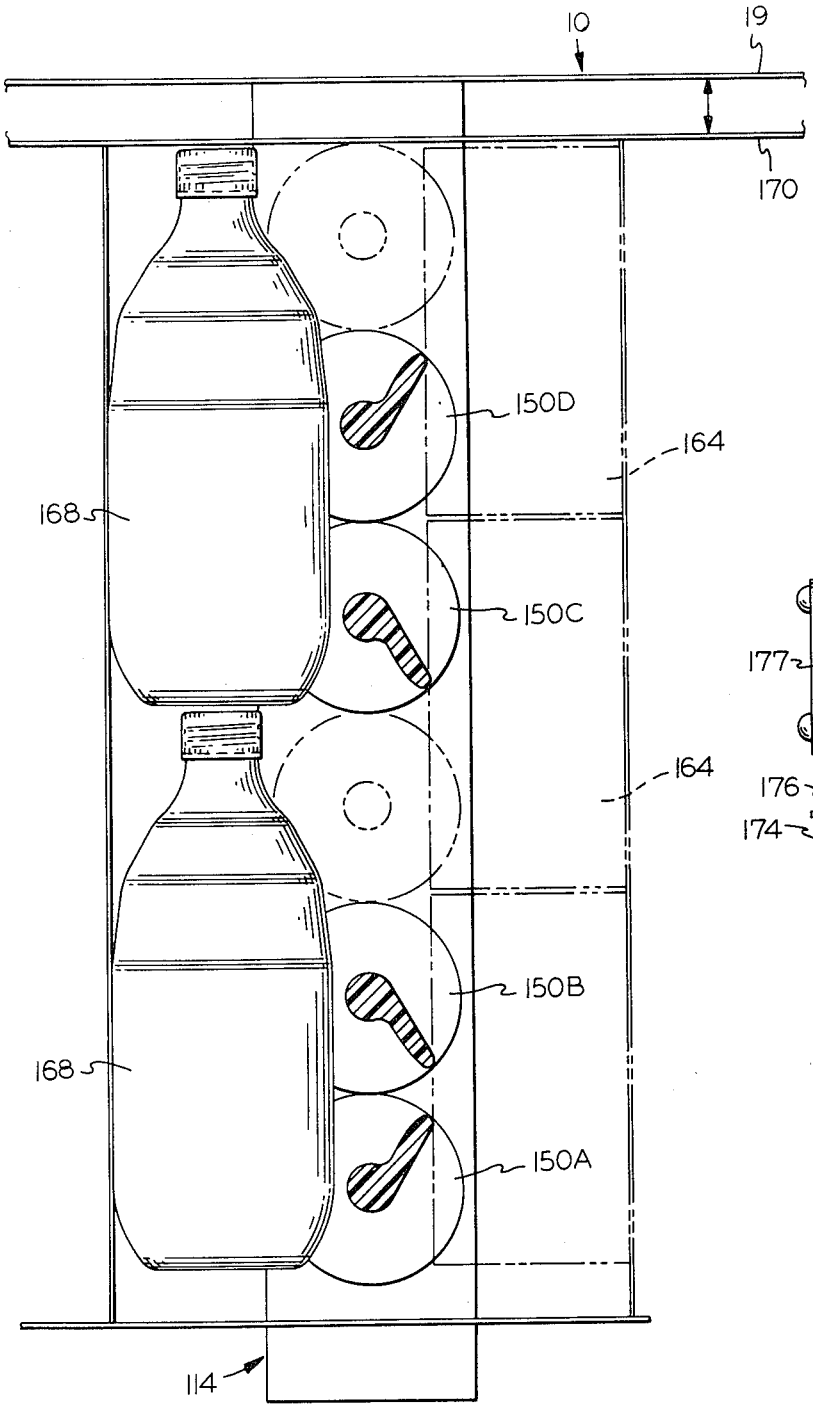
FIG. 11 is a plan view of a mechanism of the invention, showing the feeding of bottles in full line, and showing the feeding of cans in phantom line representation.

Within the upper compartment 14 are provided sidewalls 18, rear wall 19 (seen in FIGS. 2 and 11) and bottom wall 20. The compartment is divided into a series of six vertical chambers by the interior walls 22, and it is further subdivided into ten magazines by the vertical partitions 24. It is to be noted that the spaces between the outermost partitions 24 and the sidewalls 18 do not constitute product magazines, but rather serve to permit circulation through the machine of the cold air for chilling of the product.

Figure 2:
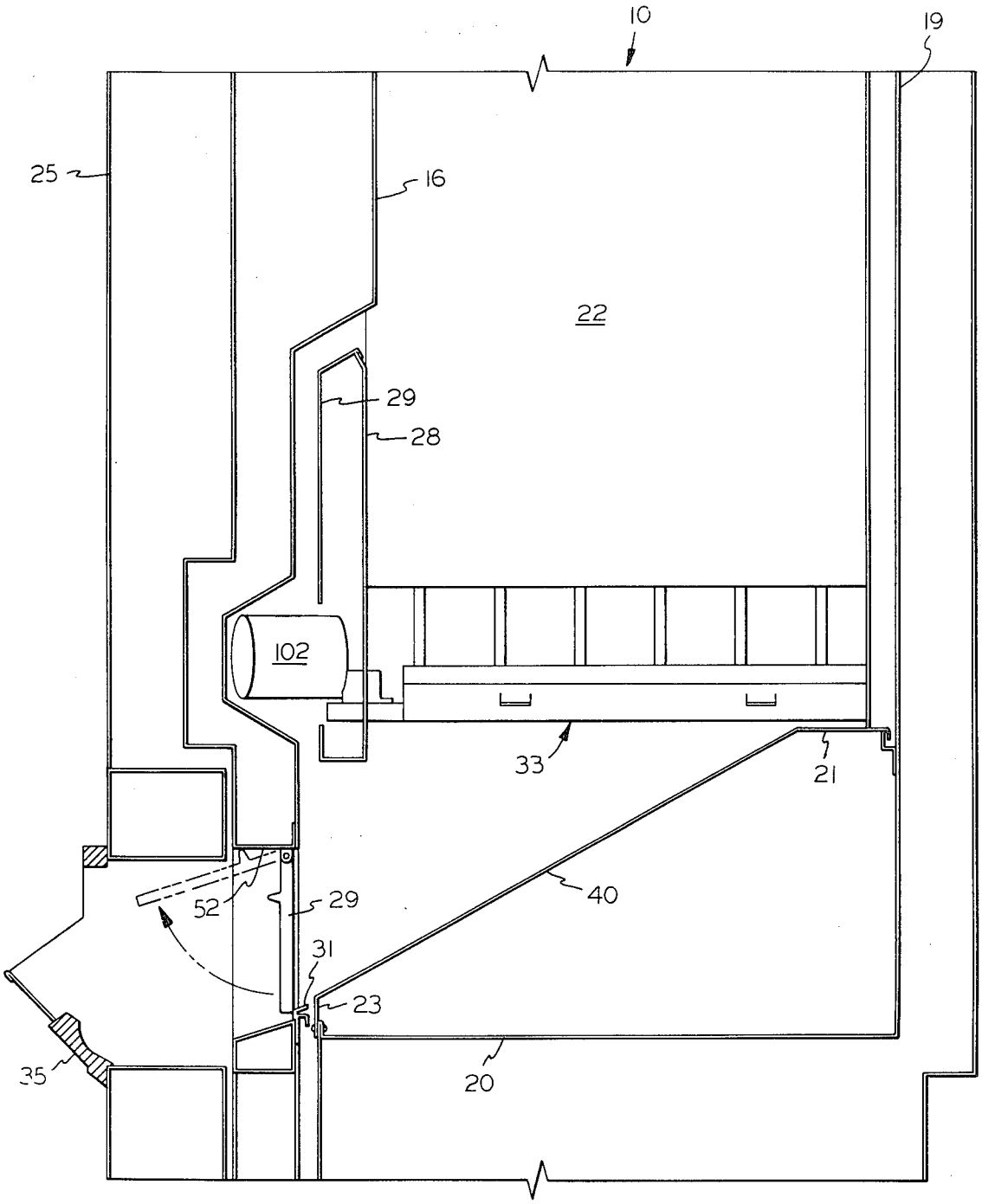
FIG. 2 is a vertical, fragmentary, schematic cross-sectional view taken through the depth of the machine of FIG. 1, drawn to a slightly enlarged scale therefrom.

Spanning the front opening of the upper compartment 14 is a vertical bracket 26, upon which is supported a front chassis plate 28; the plate 28 is normally covered by an overlying panel 29 (shown in FIG. 2). Formed in the front chassis plate 28 are six adjacent, vertically elongated, generally rectangular openings 30, and a corresponding series of six relatively small horizontal slots 32. A modular dispensing mechanism, generally designated by the numeral 33, is mounted within each of the elongated openings 30, and is bolted to the bracket 26 to secure it in position; the dispensing mechanism 33 will be described in detail hereinbelow. Although only two of them are illustrated, an "empty" switch 34 is provided for each dispensing mechanism 33, and is attached to the chassis plate 28 above each of the slots 32; a corresponding series of terminal blocks 36 are also affixed to the bracket 26.

Beneath the dispensing mechanism supporting structure are disposed a left hopper 38 and a right hopper 40, the latter being divided into two sections by a vertical divider 42. The left hopper 38 is positioned to receive product delivered from stacks contained within the four magazines in the left-hand portion of the machine, and the hopper 40 is positioned to receive the product dispensed from the remaining six magazines. Because of the width of the hopper 40, the upstanding divider 42 is provided to prevent the containers from assuming a crosswise orientation, and thereby blocking the dispensing opening. As best seen in FIG. 2, the inclined bottom walls of the hoppers terminate short of the back wall 19, and are joined to it by a narrow horizontal shelf portion 21; this is done to maximize the slope of the hoppers, and thereby promote movement of the product to the front opening of the machine. As will be noted, the bottom walls of the hoppers have a forward lip portion 23, by which they are secured to the bottom wall 20 defining the upper machine compartment 14.

A small switch plate 44 projects upwardly from the bottom wall 20, and serves to mount a temperature control 46, by which the temperature within the cabinet of the machine is adjusted to the desired level. A junction box 48 is affixed therebelow, and receives the bundle 50 of a wires, through which electrical connections to the front of the machine are established. Also visible in FIG. 1 is one of the inner door openings 52, through which the product passes from the hopper 40 for delivery to the customer.

The general relationship of the several components through the depth of the machine 10 can readily be appreciated by reference to FIG. 2. Features not shown in FIG. 1 include the outer door 25 and its passageway 27, by which communication with the interior of the machine (through the opening 52 of the inner door 16) is provided. The opening 52 has a gate 29 mounted within it, which swings outwardly (to the phantom line position) to permit free passage of the product from the machine; the stop element 31 prevents inward movement of the gate 29, and hence prohibits unauthorized entry to the product. Transverse trough structure 35 at the front of the machine serves to receive the containers, as they are discharged.

Figure 3:
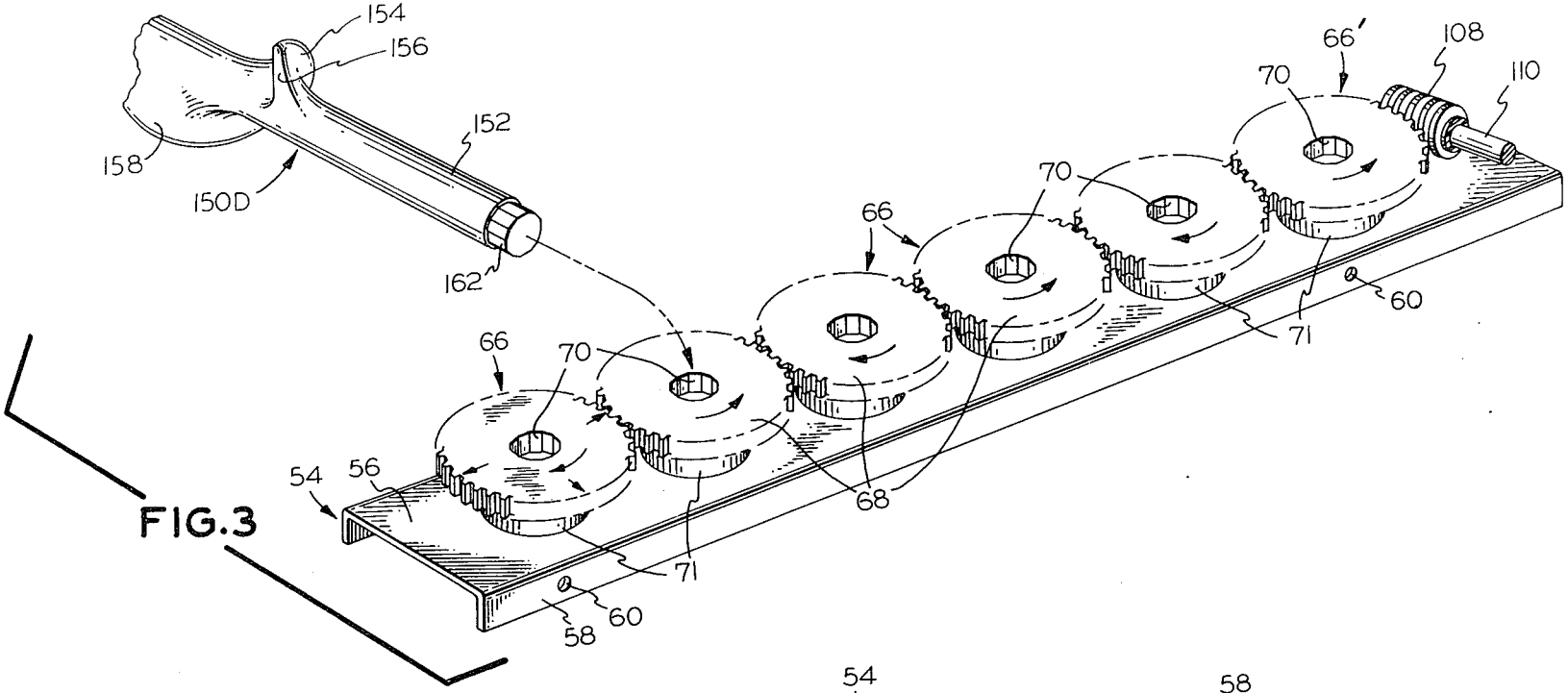
FIG. 3 is a fragmentary exploded perspective view showing a subassembly of gear members employed in the mechanism of the invention, and showing the lower portion of one of the helical carriers utilized therein.
Figure 4:
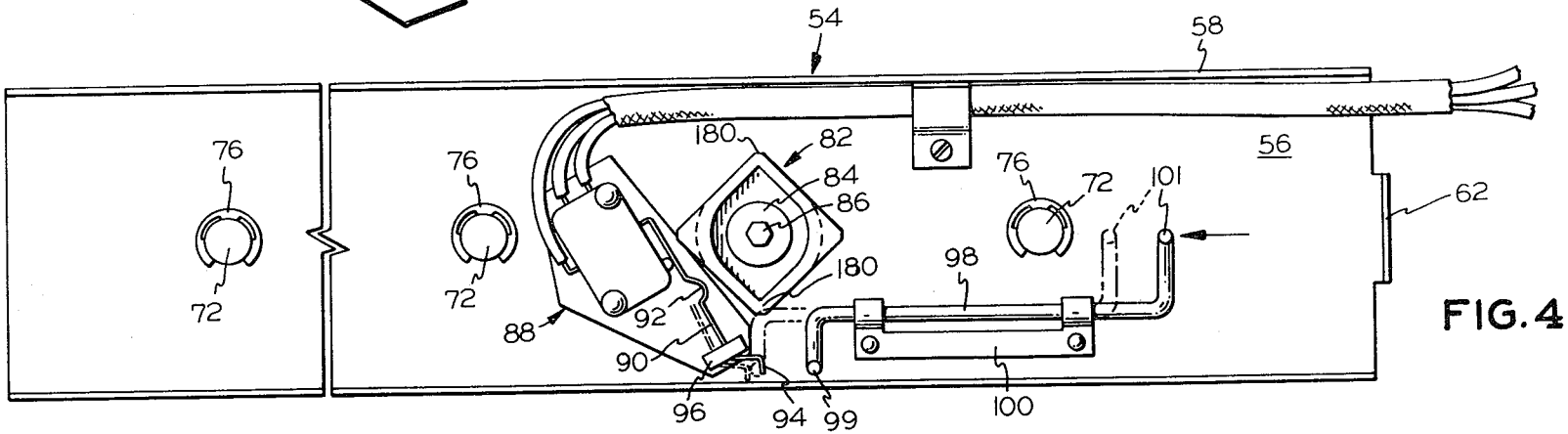
FIG. 4 is a fragmentary bottom view of the subassembly of FIG. 3, drawn to a somewhat enlarged scale.

FIGS. 3 and 4 show details of the gear bank subassembly used in the dispensing mechanism of the invention, which includes base, generally designated by the numeral 54. The base 54 consists of a planar wall 56 and two lateral flanges 58 which depend therefrom and which have sets of holes 60 formed therein for securing of a cover, as will be described subsequently. Also depending from the planar wall 56 is a short outer end mounting bracket 62, which has a hole formed therethrough to permit passage of a threaded fastener 64 (shown in FIG. 5); the fastener 64 engages the horizontal bracket 26 to secure the mechanism 33, as previously pointed out.

Figure 7:
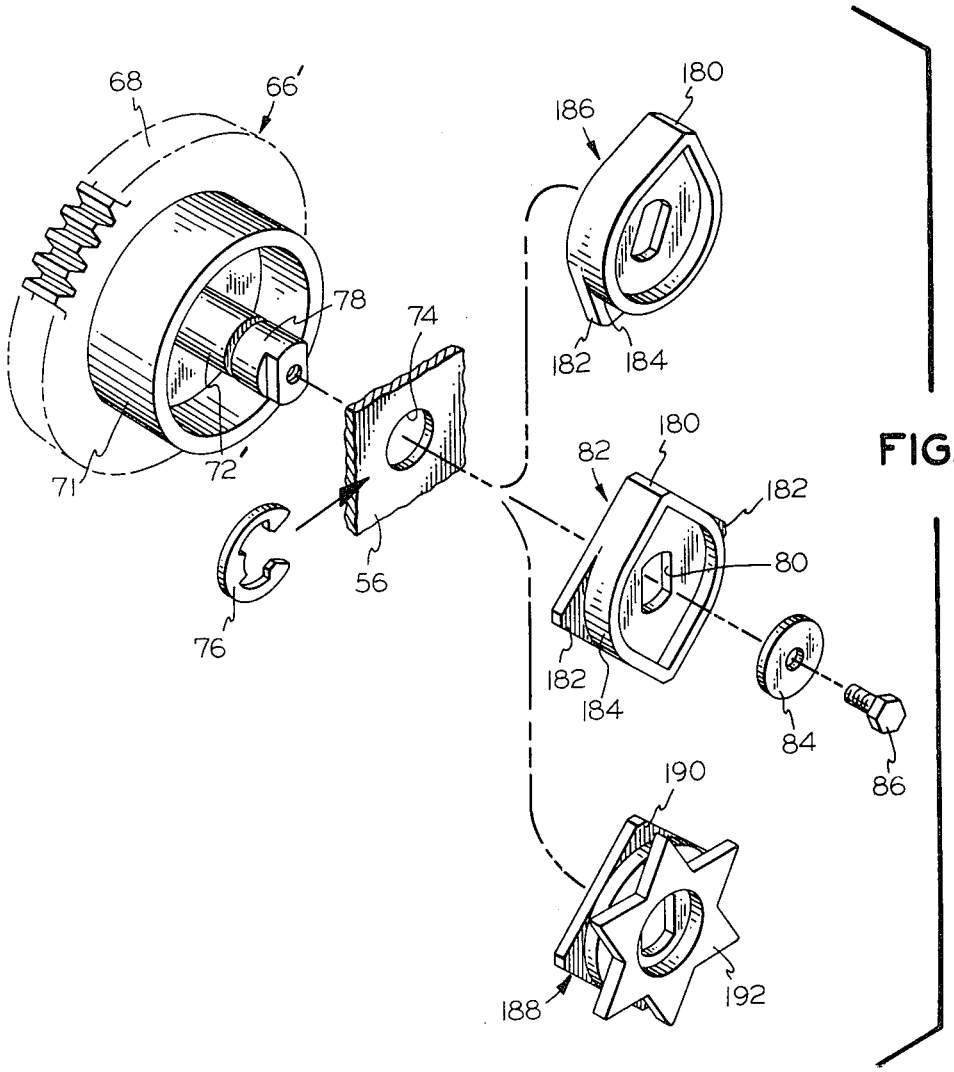
FIG. 7 is an exploded perspective view illustrating the means of attachment of the cam member to one of the gear members of the mechanism, and illustrating three different forms of cam members that are suitable for use.

Rotatably mounted on the base 54 are six gear members, generally designated by the numerals 66, 66', each of which has a gear portion 68 and a reduced diameter cylindrical base portion 71. The gear portions 68 have dodecagonal (12-sided) sockets 70 formed therein, and a stub axle 72, 72' extends axially downwardly from the gear portion 68 and through the base portion 71 of each of the gear members 66, 66', respectively. The stub axles 72, 72' project through holes 74 (one of which is seen in FIG. 7) provided in the wall 56, and they are secured thereunder by spring clips 76.

The stub axle 72' of the gear member 66' is slightly longer than the stub axles 72 of the remaining gear members 66, to permit mounting thereon of the cam member, generally designated by the numeral 82. As best seen in FIG. 7, the axle 72' has a flatted end portion 78, and the cam member 82 correspondingly has a chordally reduced aperture 80, permitting the cam member 82 to be axially mounted thereon in engagement against relative rotation; the bolt 86 and the washer 84 maintain the cam member 82 in assembly on the axle 72'.

With particular reference to FIG. 4, it is seen that the base 54 of the gear bank sub-assembly has mounted on its underside a microswitch, generally designated by the numeral 88, which includes an operating lever 90, in turn having a cam follower bump 92 intermediate its ends and a short foot element 94 at its free outer end. The operating lever 90 passes through a small rectangular frame portion 96, which serves to constrain its movement to prevent damage, distortion or malfunction. Slidably mounted in a bracket 100 adjacent to the microswitch 88 is a manual operating rod 98, which has a short projection 99 for contact with the foot element 94 of the microswitch operating lever 90. A second projection 101 is provided at the opposite end of the rod 98 to provide means by which it may be grasped and manipulated. In this manner, means is provided for actuating the switch 88, so as to permit manual operation of the machine, such as for adjustment and servicing; the operative position of the rod 98 is shown in phantom line.

Figures 5, 6:
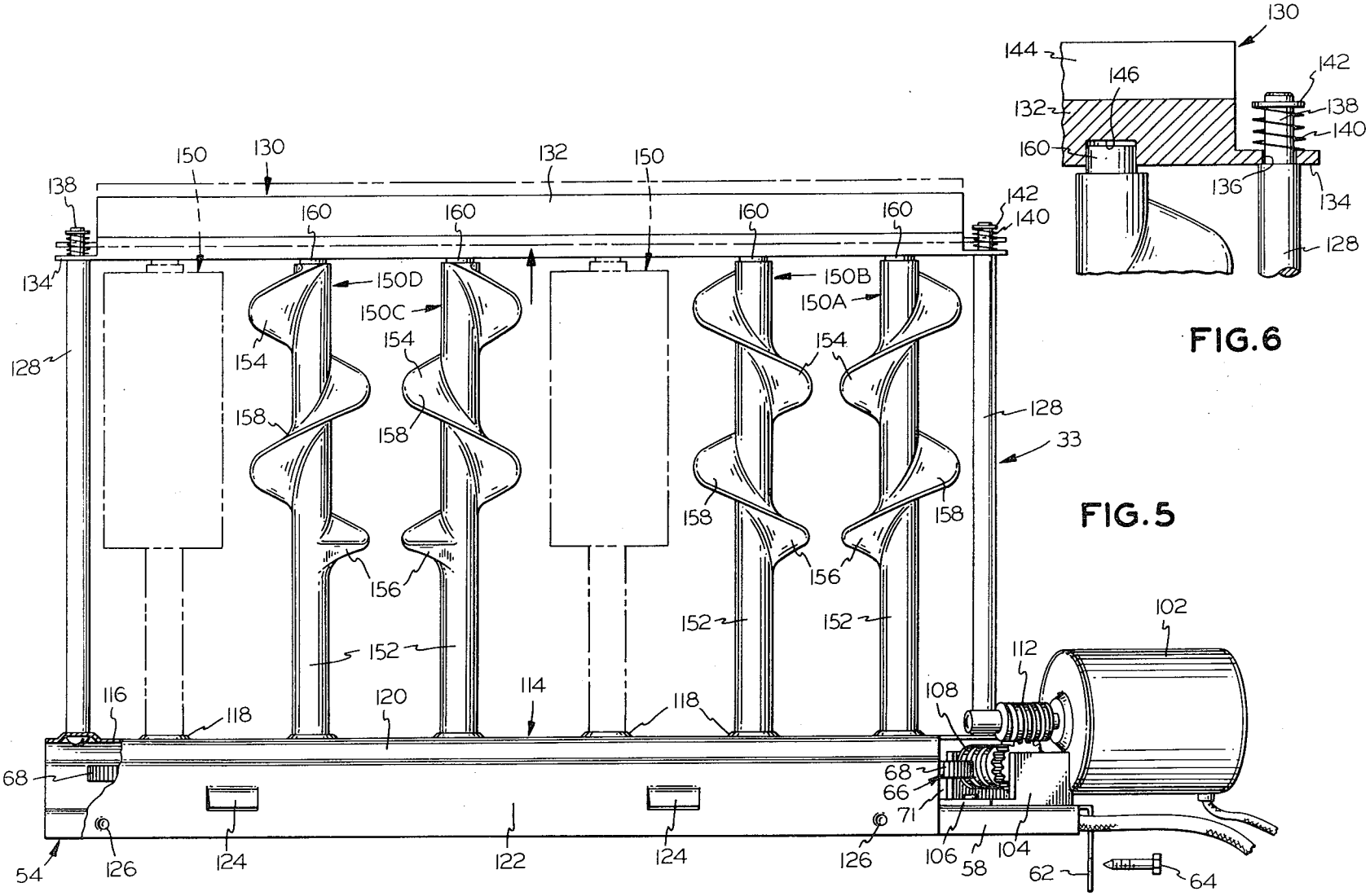
FIG. 5 is a side elevational view of a modular dispensing mechanism, with two of the removable helical carriers and the displaced position of the tie bar shown in phantom line, and with portions of the housing of the module broken away to expose inner parts thereof.
FIG. 6 is a fragmentary enlarged view, in partial vertical section, of the upper right-hand portion of the mechanism of FIG. 5, showing the details of engagement between the carrier and the tie bar.
Figure 9:
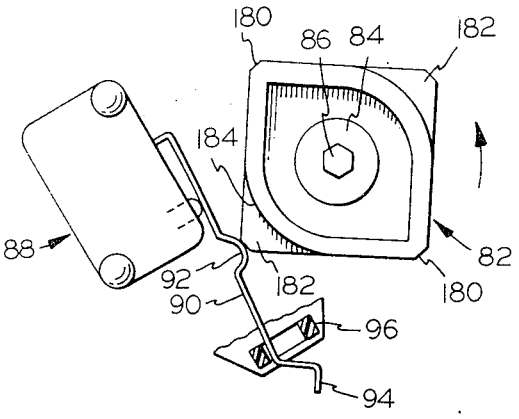
FIG. 9 is a view similar to FIG. 8, with the cam member inverted on the gear member axle.
Figure 8:
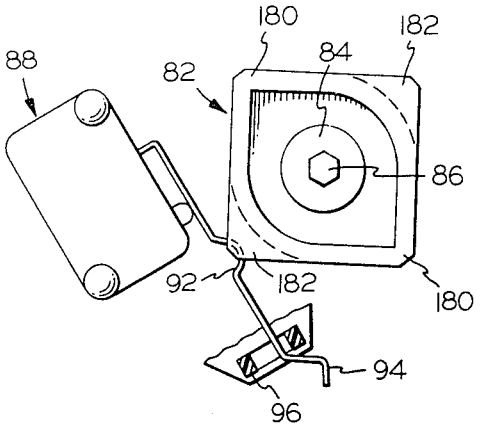
FIG. 8 in an enlarged view of the microswitch and cam member employed in the mechanism illustrated in FIG. 4, with the cam member rotated somewhat from the position shown therein.

Turning now in more detail to FIG. 5 of the drawings, a small electric motor 102 is shown mounted on the outer end of the base 54, and for that purpose has a mounting bracket 104 integrally formed with its housing. The forward edge of the bracket 104 is engaged under a flanged stop plate 106 affixed to the base 54; although not illustrated, at its opposite side the bracket 104 is secured adjacent the outermost portion of the base 54 by a single bolt; thus, removal of the motor from the assembly will be most facile. A worm gear assembly 108 is rotatably mounted upon a shaft 110, which in turn extends transversely across the bracket 104. The worm gear assembly 108 is in meshing engagement with the worm gear 112 fixed to the shaft of the motor 102, and is also in engagement with the gear portion 68 of the outermost gear member 66. Energization of the motor will therefore effect simultaneous rotation of all of the gear members 66, 66', and because the gear portions 68 thereof are of equal diameter and carry an equal number of teeth, the members will all rotate at precisely the same speed. Although not noted previously, the gear portions carry small timing marks (designated by unnumbered arrows shown thereon in FIG. 3), permitting ready positioning of the gear members 66, 66' in the proper phase relationship to one another during manufacture of the sub-assembly.

As is also seen in FIG. 5, the base 54 has mounted upon it a cover, generally designated by the numeral 114, which (albeit that the ends are open) substantially encloses the bank of gears and protects them from damage and contamination, such as might otherwise occur due to product spilled from broken bottles, ruptured cans, or the like. The cover 114 has an upper wall portion 116 through which are formed six circular openings (not visible) defined by upstanding collar portions 118. The upper wall portion 116 is joined to depending sidewall portions 122 by sloped shoulders 120, which are configured to facilitate discharge of the containers in a manner peculiar to the present mechanism. Small rectangular tab elements 124 are punched from the sidewall portions 122 and are deformed inwardly to bear upon the upper surface of the planar wall 56 of the base 54 (best seen in FIG. 10). Also formed in the sidewall portions 122 are pairs of hemispherical detents 126, which are located for engagement within the circular holes 60 provided in the depending flanges 58 of the base 54. Thus, the detents 126 permit the cover 114 to be snapped into engagement with the base 54, with the inwardly extending tab elements 124 preventing the cover from being forced so far downwardly upon the base as to cause interference with the gear members 66, 66'.

A pair of upstanding posts 128 are secured to the cover 114, one adjacent each of its opposite ends. The posts 128 support upon their upper ends a tie bar or crosspiece, generally designated by the numeral 130, having an elongated body portion 132 and ears 134 projecting from the opposite ends thereof. Each of the ears 134 has an aperture 136, through which is inserted the reduced diameter tip 138 of the associated supporting post 128, and a coil spring 140, retained by a clip 142, exerts a downward bias thereupon. As best seen in FIG. 6, a slot 144, extending the full length of the body portion 132, is formed downwardly thereinto, and a series of six blind circular bores 146 extend upwardly into the body portion 132 at equidistantly spaced locations along its length; the purpose underlying this construction will be discussed more fully hereinbelow.

Figure 10:
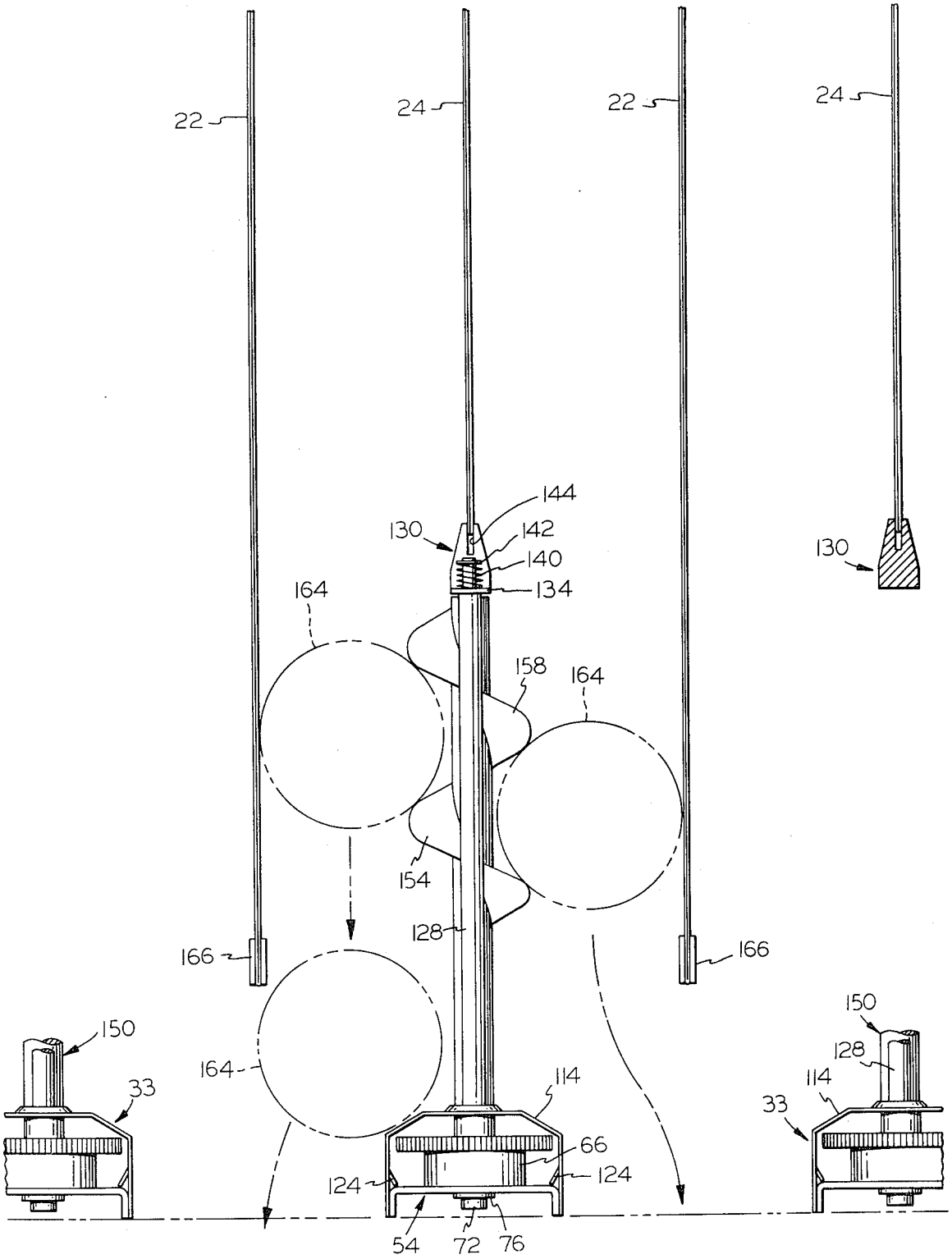
FIG. 10 is a somewhat diagrammatical, fragmentary vertical cross-sectional view taken through the width of the machine, showing three of the dispensing mechanisms utilized therein, and illustrating the manner in which the mechanism operates to dispense containers from stacks in two adjacent magazines thereof.

Passing through the cover 114 and into engagement within the socket 70 of each of the gear members 66, 66' is a helical carrier, generally designated by the numeral 150; this assembly is seen most clearly in FIGS. 5 and 10. In FIG. 5, the carriers 150 have been differentiated from one another by the letters A–D, with carrier 150A being the outermost one, and carrier D being the one positioned most deeply within the machine when the module is installed. Two of the carriers are unlettered and are shown in phantom line, so as to indicate that their presence is optional, and is dependent upon the selected mode of operation; this feature of the mechanism will be discussed in greater detail hereinbelow.

The helical carriers 150 consist of a shaft portion 152 with a helical thread 154 extending thereabout and having a lower end portion terminating in a straight, vertical face 156. As will be appreciated, the thread 154 defines a spiral groove or convolution 158 on the carrier 150, within which the cylindrical article to be dispensed is carried. The shaft 152 has an upper end portion 160 of reduced diameter which is journaled within the corresponding bore 146 of the tie bar 130 of the supporting frame, and is thereby provided overlying support. The lower end portion 162 of the shaft 152 is formed to have a dodecagonal cross-section, dimensioned for snug seating within the socket 70 of the gear member 66, 66' with which it is associated. As will be evident, the matched dodecagonal configuration of the socket 70 and end portion 162 enables ready interengagement against relative rotation, when the members are assembled with one another, in any of twelve relative rotational positions; i.e., twelve positions displaced 30° from one another are possible with each carrier and gear member set.

With reference now to FIG. 10 of the drawings, the inside of the machine is diagrammatically illustrated, to depict three adjacent racks of carriers and to show the relationship between the central rack and two laterally adjacent stacks of cans supported thereby within a chamber (i.e., two adjacent magazines) of the machine. As indicated previously, the chamber is defined between the interior walls 22, and is divided into adjacent magazines by the partition 24. The lower edge portion 25 of the partition 24 is received within the slot 144 in the tie bar 130, thus providing an integrated and rigidified assembly. As will be appreciated, the slot 144 is of a depth sufficient to permit the tie bar to be lifted high enough to clear the carriers 150, thereby permitting their disengagement from the sockets 146 and removal from the carrier mechanism.

Each of the magazines contains a stack of cans 164, which are disposed lengthwise from front-to-rear within the machine. The lowermost cans in both stacks are supported by the carrier 150, with individual cans 164 lying within the convolution 158 thereof. Because of the pitch of the helical thread 154, the cans 164 are maintained in a vertically staggered relationship, in which relationship they are transported downwardly during rotation of the carrier 150, by reason of their trapped position against the adjacent wall 22. In the phase of operation shown in FIG. 10, the first can in the left-hand magazine has just been released by the carrier 150, due to the presentation of its flat face 156 on that side of the mechanism. The can has therefore dropped upon the cover 114 of the base 54, from which position it may roll on the shoulder 120 under the lower edge 166 of the adjacent interior wall 22. The edge 166 comprises an elongated protective strip of plastic or similar smooth material, and is aligned parallel to the adjacent shoulder 120, to cooperatively define therewith a longitudinal passage of uniform width. This arrangement of the sidewall 22 and the cover 114 permits smooth, gentle release of the can laterally from the mechanism, for passage into the associated one of the discharge hoppers 38, 40, and the combination represents a unique feature of the instant machine.

Rotation of the carrier 150 in response to a subsequent actuation of the mechanism will cause the lowermost can 164 in the right-hand magazine to descend gradually until the straight face 156 of the thread 154 is presented to the right adjacent wall 22. Thereupon, it too will drop and be discharged in the manner described but, of course, to the opposite side of the carrier mechanism. In this manner, the cans in the adjacent stacks illustrated will be discharged smoothly and relatively gently, one at a time, alternatingly from each side of the mechanism. As will be appreciated, the two adjacent racks of carriers shown in FIG. 10 operate in precisely the same manner to dispense the containers from the stacks with which they are associated, with actuation of any particular mechanism depending, of course, upon the selection made by the customer. It will furthermore be understood that an aligned carrier, positioned behind the illustrated carrier (and therefore not visible in this Figure) and rotating counter thereto, will coact therewith to provide the support and effect the discharge functions described.

In the particular arrangement shown for illustrative purposes in FIG. 5, carriers 150A–150D are disposed to dispense the containers from two stacks arranged one behind the other in the depth of the machine, and from only one side of the carrier bank, such as would be appropriate for the magazines located laterally outermost within the compartment 14. Thus, assuming that containers are stacked two deep only in the extreme right-hand magazine, as is true of the bottles 168 shown in FIG. 11, and that the space to the right of the carriers is empty (i.e., that the cans 164 are absent), the arrangement of FIG. 5 would be effective to dispense two bottles during each 360° cycle of operation, with a bottle being dispensed first from the mated carriers 150A and 150B, and then from the pair of carriers 150C and 150D. Obviously, this specific arrangement could not be used to dispense containers from both sides of the carriers, because they are 180° out of phase with one another; double-sided operation would cause two containers to drop simultaneously (one from each pair of carriers) during each half of the cycle.

The cam member 82 is selected and positioned in the illustration of FIG. 4 to properly control the "vend limit" microswitch 88 to achieve of the dispensing operation just described. Specifically, the switch 88 is of the double pole/single throw type, with a normally closed contact through which a circuit to the motor 102 is established during a vend cycle. When the vend cycle has been completed, one of the lobes of the cam member 82 engages the operating lever 90, thus breaking the primary circuit while at the same time establishing a secondary circuit through the other contact of the switch 88. This ensures that the cam member will rotate to a position beyond the point of apex contact with the cam follower bump 92, thereby reestablishing the primary circuit through the motor; it also permits the motor to be energized by operation of the manual operating rod 98.

Because the cam member 82 is mounted to present two cam elements or lobes to the operating lever 90 during each cycle of revolution (the cam elements in question being provided by the two full thickness apexes 180), movement of the bank of carriers 150 will cease twice during each cycle. At one of those points, a bottle 168 will be released from one of the sets of two cooperating carriers, and at the other point, 180° out of phase with the first, a second bottle will be dropped from the other set. Should, however, it be desirable to utilize the same mechanism with four carriers to dispense bottles from two adjacent magazines, still with a double-depth arrangement of stacks, it is necessary merely to rotate two of the cooperating carriers (i.e., 150A and 150B) within the sockets 70 of their associated gear members 66, 66' (by elevating the tie bar 130 to permit their disengagement) to positions at which their common release point is 90° out of phase with the release point of the other set of carriers (i.e., 150C and 150D), and to reverse the cam member 82 on the stub axle 72', so as to present four cam elements (provided by both the full thickness apexes 180 and also the half thickness apexes 182) to the operating lever 90. As so modified, the mechanism will stop at each of four positions 90° out of phase with one another, enabling discharge which may for example proceed in the sequence: right front stack, right rear stack, left front stack, and finally left rear stack.

With reference again to FIG. 11, the alternative embodiment shown in phantom line is adapted to permit the sequential dispensing from three stacks of cans 164 aligned one behind the other in the machine. To do so, the rack is provided with a full complement of six carriers (the two added carriers being shown in phantom line), with the phase relationship among the carriers being set to provide three cooperating pairs, timed 60° out of phase with one another. In other words, carriers 150A and 150B may be maintained in the relationship shown; the next carrier in line (added, and having no letter designation) and carrier 150C would be positioned in the sockets 70 of their respective gear members 66 so as to provide a cooperative release point 60° displaced from the release point of the first two carriers; and carrier 150D and the second unlettered carrier would be disposed to provide a release point 120° out of phase, again relative to the first two carriers in the line. As a result (and assuming the presence of stacks of cans on both sides of each set of carriers), six cans would be dropped individually during each full cycle, in the sequence: front right, middle right, rear right, front left, middle left and finally rear left. Other sequences are of course possible, and it will be appreciated that a similar arrangement of carriers could be utilized for single-sided operation, in which instance the drop points of the carrier sets would be mutually displaced by 120° (rather than 60°), so as to release only three cans during each full cycle.

In all instances, the cam member configuration will be designed to accommodate the particular mode of operation selected. Again referring to FIG. 7, the cam 188 is adapted to enable conversion between four-container-per cycle and six-container-per cycle dispensing modes, in accordance with a fundamental feature of the invention, side 190 thereof being configured with four lobes and side 192 having six lobes for that purpose. With the four-apex side 190 in position for operating lever 90 of the microswitch 88, the dispensing mechanism would generally be adapted to discharge containers from four stacks arranged side-by-side and two-deep within the machine; the six apex side 192 would, of course, be used to dispense containers from a two-by-three array of stacks.

The third cam member shown in FIG. 7, generally designated by the numeral 186, permits a choice between one or two lobes, provided by the full thickness apex 180 and the half-thickness apex 182; a transition surface 184 is defined therebetween. This cam would be used to dispense from either one or two stacks of containers, which may be disposed either side-by-side or one behind the other.

Figure 12:
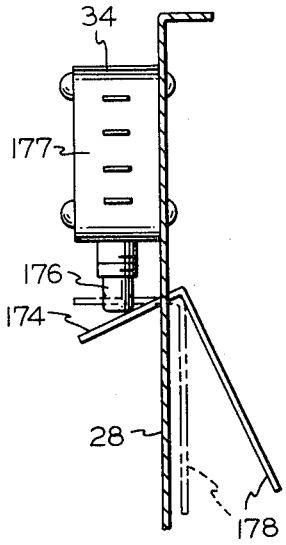
FIG. 12 is an enlarged sectional view showing an "empty" switch mounted on the front chassis plate of the machine, and showing in full and phantom line the two alternative positions of the switch-operating lever.

It is, of course, conventional to provide machines of the present sort with "empty" switches, to indicate when the supply of a particular product has become nearly exhausted, and to prevent normal operation of the associated carrier mechanism. FIG. 12 shows such a switch 34, having a plunger 176 slidably mounted within its body 177 and outwardly biased to engage the L-shaped operating lever which is mounted within the underlying horizontal slot 32. The lever has a relatively short contact leg 174 and a relatively long operating leg 178 disposed within the associated magazine of the machine. When the supply of containers is adequate, one of them will bear upon the operating leg 178, causing the contact leg 174 to force the plunger 176 into the housing 177, closing the operating circuit of the carrier mechanism 33 (connected thereto through one of the terminal blocks 36) thus permitting normal dispensing. When, however, the magazine is empty (or nearly so), the plunger 176 will move outwardly, thereby breaking the circuit and preventing further automatic dispensing until the supply of product has been replenished.

Figure 13:
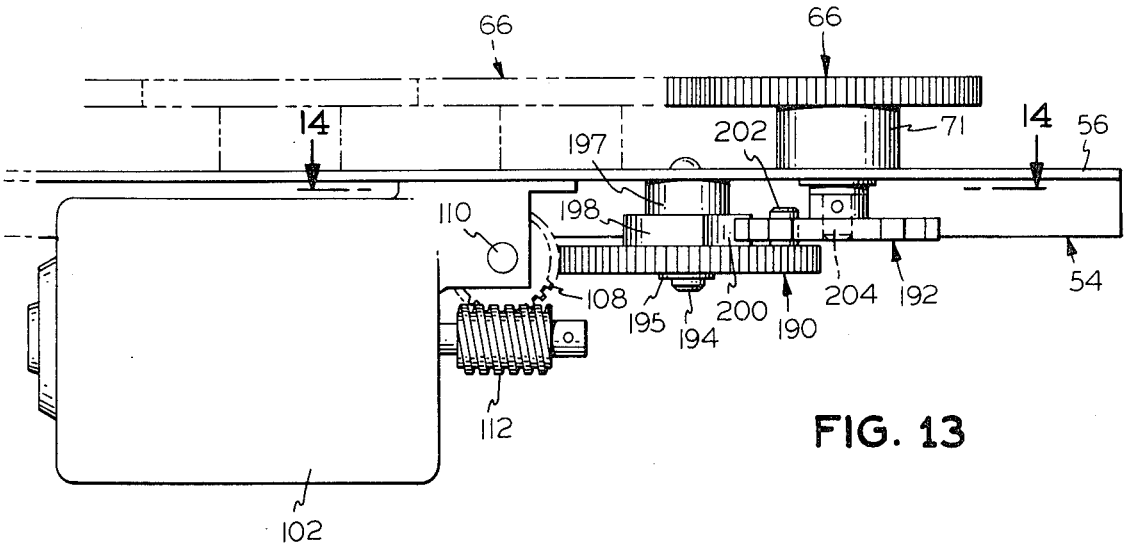
FIG. 13 is a fragmentary side elevational view of the base of the carrier mechanism, in which an alternative form of the drive train is employed.
Figure 14:
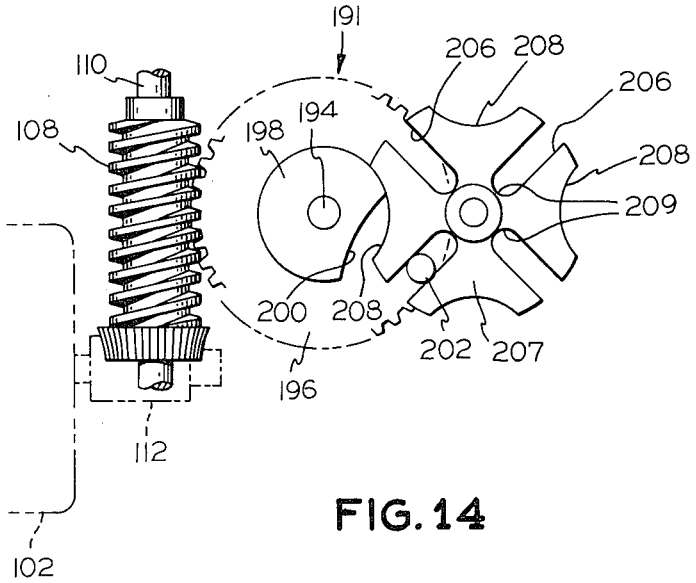
FIG. 14 is a fragmentary top view of the drive train of FIG. 13, with the motor shown partially and in phantom line.

Turning finally to FIGS. 13 and 14, the Geneva drive train illustrated therein represents an especially desirable embodiment of the invention. Firstly, it helps to ensure that each of the drop points will be accurately attained and maintained; this is especially important when there are six drop points displaced 60° out of phase with one another, since the tolerances are minimal and accuracy is imperative to avoid malfunctions. While not as severe, similar difficulties may be encountered in providing a four-drop cycle, and hence such a drive train may also be advantageous in those instances. Secondly, the Geneva-type mechanism is desirable from the standpoint of affording smooth operation, especially at the beginning and end of each phase of the cycle. This not only makes the release of the containers relatively gradual and gentle, but it also minimizes loading, and consequential wear, upon the moving parts.

The Geneva drive, more specifically, comprises a drive wheel, generally designated by the numeral 191, and an indexing wheel, generally designated by the numeral 193. The drive wheel 191 is rotatably mounted on the shaft 194, which projects downwardly from the planar wall 56 of the base 54; it is retained thereon by a spring clip 195, and is maintained at a proper level beneath the wall 56 by a spacer 197. The drive wheel 191 consists of a circular gear portion 196 and a cylindrical locking hub portion 198, which is of reduced diameter and has an arcuate recess 200 formed therein. Disposed outwardly of the hub portion 198 and on the radius of the recess 200 is a drive pin 202, which projects upwardly from the gear portion 196 and is affixed thereto.

The indexing wheel 193 is secured to the shaft extension 204 of the outermost gear member 66, and is positioned in transverse alignment with the hub portion 198 and drive pin 202 of the drive wheel 191. It is divided into quadrants 207 by four radially-extending slots 206, each quadrant having an arcuately recessed outer edge 208. The slots 206 are dimensioned and configured to receive and slidably engage the drive pin 204 of the drive wheel 191, and are of such a depth as to cause the fully inserted pin 204 to bear closely upon the curved inner end surfaces 209, thereby effecting smooth turning thereupon. The arcuate recesses of the quadrant edges 208 have a radius of curvature matching that of hub portion 198, and are spaced radially from the axis of the indexing wheel such a distance as to cause the unrelieved circumferential portion of the hub 198 to bear thereupon during movement of the pin 202 into and out of the slots 206. The arcuate recess 200 of the hub portion 198 is presented to the indexing wheel 193 only when the pin 202 has attained is innermost position within the slot engaged, whereupon the indexing wheel 192 is released for rotation. Thus, the accuracy, precise positioning and smoothness of operation desired are be achieved. It will be evident that the drive wheel 191 is driven by the motor 102 through meshing engagement with the worm gear assembly 108, as previously described. It will also be understood that the indexing wheel 193 is rotated through only one quarter of a turn during each full revolution of the drive wheel 191, the particular configuration illustrated being intended for use in providing a four-phase cycle of operation. To adapt the mechanism to operate in a six drop points per cycle mode, the indexing wheel would of course be formed with six slots formed at 60° arcuate intervals thereabout. Interchangeable indexing wheels would, of course, be provided to facilitate conversion between different modes of operation.

Although not described in detail, it will be appreciated that the vending machines of the present invention will have certain standard features, such as to enable facile and effective loading, cooling, operating, and other functions generally associated therewith, which will be evident to those skilled in the art. As mentioned, the refrigerating system will generally have its components disposed within the lower compartment 12 of the cabinet 10, with appropriate spaces and channels being provided to promote complete and effective cooling of the product. This assumes that the machine is to be used for cold drinks or a similar product, which need not, of course, necessarily be the case; virtually any generally cylindrical article or package of appropriate size and construction can be dispensed from the vending machines described herein.

Thus, it can be seen that the present invention provides a novel dispensing mechanism for a vending machine, which may readily be converted between alternative modes of operation, for selective use with either double- or triple-depth stacking. The mechanism, and the vending machine incorporating it, effect dispensing of the articles smoothly, relatively gently and in a most dependable and desirable manner. In general, the mechanism is of relatively uncomplicated design, and is therefore convenient to adjust and repair, and relatively inexpensive to manufacture.

Having thus described the invention, what is claimed is:

1. A convertible mechanism for dispensing generally cylindrical articles from a plurality of stacks contained in a vending machine, comprising: support means, including a base; at least three gear members mounted in meshing engagement with one another on said base for simultaneous rotation about parallel, generally rectilinearly aligned axes; at least three helical carriers vertically mounted on said support means and adapted to support the articles generally horizontally within their convolutions, each of said carriers being aligned on the axis of rotation of one of said gear members and having an upper helix portion and a lower helix portion, said upper helix portion being adapted to receive the articles and said lower helix portion being adapted to permit the release thereof at at least one rotational position of said carrier, each of said gear members having an axial, upwardly opening socket in which a lower end portion of the associated carrier is seated, said socket and end portion being cooperatively dimensioned and configured to permit removal of said associated carrier and to permit interengagement thereof for conjoint coaxial rotation in any of a plurality of angularly displaced relative positions; whereby the articles, withdrawn from the stacks and progressively lowered within the convolutions of said carriers during rotation thereof, can be discharged in a predetermined sequence depending upon the relationship between said lower helix portions of said carriers, and whereby said mechanism may be employed to dispense the article from three stacks disposed one behind another in the machine, and may be converted, by removal of at least one of said carriers and alteration of carrier position within said sockets to change the timing of discharge, for the dispensing of articles from only two of such stacks.

2. The mechanism of claim 1 wherein said support means additionally includes means for biasing said one carrier towards said base, said one carrier being axially displaceable away from said base against the force of said biasing means.

3. The mechanism of claim 2 wherein said support means additionally includes a frame portion attached to said base and providing overlying support for said helical carriers, said frame portion comprising upstanding members attached adjacent the opposite ends of said base and a tie bar extending longitudinally above said base and supported upon the upper ends of said upstanding members, said biasing means acting to bias said tie bar toward said base.

4. The mechanism of claim 1 wherein six each of said gear members and carriers are provided, said carriers being affixed to coact in pairs with said pairs serving to dispense the articles from different stacks.

5. The mechanism of claim 4 additionally including a motor; switch means for deenergizing said motor at each of said release positions of said gear members; and a drive train operatively connecting said motor to said gear members, said drive train comprising Geneva movement means for positively limiting the arc of rotation of said gear members and thereby precisely locating and maintaining said release positions thereof, whereby the articles, withdrawn from the stacks and progressively lowered within the convolutions of said carriers during rotation thereof, can be discharged one at a time, smoothly and gradually, with a high degree of regularity and dependability.

6. The mechanism of claim 5 wherein said Geneva movement means comprises a driven indexing wheel having formed therein a multiplicity of equidistantly spaced, inwardly extending radial slots and arcuate recesses therebetween; and a radially adjacent drive wheel having a cylindrical hub portion extending axially outwardly from one side thereof with an arcuate recess formed therein, and having a drive pin spaced radially outwardly from said hub, disposed on the radius of said hub recess and extending outwardly from said one side of said drive wheel, said slots of said indexing wheel corresponding in number to said article release positions, and being dimensioned to slidingly engage said drive pin of said drive wheel for partial rotation of said indexing wheel thereby through said limited arc, said hub engaging in one of said arcuate recess of said indexing wheel adjacent the engaged slot to constrain said indexing wheel against rotation except when said pin is substantially bottomed within said engaged slot, whereupon said recess of said hub is presented to said indexing wheel, permitting passage of its elements therethrough and rotation thereof.

7. In a vending machine, the combination including: at least one mechanism for dispensing generally cylindrical articles from a plurality of stacks contained in said machine, said mechanism comprising support means, including a base; a plurality of gear members mounted in meshing engagement with one another on said base for simultaneous rotation about parallel, generally rectilinearly aligned axes; a plurality of helical carriers vertically mounted on said support means and adapted to support the articles generally horizontally within their convolutions, each of said carriers being aligned on the axis of rotation of one of said gear members and having an upper helix portion and a lower helix portion, said upper helix portion being adapted to receive the articles and said lower helix portion being adapted to permit the release thereof at at least one rotational position of said carrier; means for affixing said carriers to said gear members for conjoint, coaxial rotation; a cover extending over said base and enclosing said gear members, said cover having an upper wall portion through which said carriers project, and sloped shoulder portions extending longitudinally along both sides thereof; said machine additionally including a plurality of walls defining at least two laterally adjacent magazine for containing such stacks of articles, with one of said magazines being disposed to each side of said dispensing mechanism, the wall between said adjacent magazines lying in a plane passing through the vertical axes of said carriers, and the outer walls defining said magazines having lower edges aligned parallel with and offset laterally above the adjacent shoulder portion of said cover, to define longitudinal passages of uniform width along the bottom and to each side of said dispensing mechanism; and at least one hopper disposed below said dispensing mechanism and positioned to receive the articles discharged from said carriers thereof; whereby the articles, withdrawn from the stacks and progressively lowered within the convolutions of said carriers during rotation thereof, can be discharged smoothly and gently laterally through said longitudinally extending passages, for ultimate dispensing by said machine.

8. The machine of claim 7 wherein said upper wall portion and said shoulder portions of said cover are each substantially planar.

9. The machine of claim 8 wherein said cover includes sidewall portions depending from said shoulder portions, said cover substantially enclosing said base of said mechanism.

10. The machine of claim 7 wherein said hopper has a bottom wall that slopes downwardly toward the front of said machine, the rear of said bottom wall terminating a substantial distance short of the rear of said machine to maximize the angle of decline, and thereby to promote the movement of the dispensed articles toward the front of said machine.

* * * * *